US010153583B1

(12) United States Patent
Irish

(10) Patent No.: US 10,153,583 B1
(45) Date of Patent: Dec. 11, 2018

(54) CONNECTOR ASSEMBLY

(71) Applicant: Sumitomo Wiring Systems, Ltd., Yokkaichi, Mie (JP)

(72) Inventor: Danielle Irish, Farmington Hills, MI (US)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 15/651,506

(22) Filed: Jul. 17, 2017

(51) Int. Cl.
*H01R 13/56* (2006.01)
*H01R 13/58* (2006.01)
*H01R 24/20* (2011.01)

(52) U.S. Cl.
CPC ..... *H01R 13/5837* (2013.01); *H01R 24/20* (2013.01)

(58) Field of Classification Search
CPC ..... H01R 13/5837; H01R 13/518; H01R 13/6215; H01R 24/20; H01R 9/226; H01R 9/2416; H02B 1/18; H05K 7/026; B60R 16/0238; H01H 85/2035
USPC ..... 439/449
See application file for complete search history.

(56) References Cited

U.S. PATENT DOCUMENTS 4,923,411 A * 5/1990 Hayashi ..... H01R 13/518 439/540.1
5,411,416 A * 5/1995 Balon ..... G06F 1/1632 439/540.1
5,451,170 A 9/1995 Suffi
5,545,053 A * 8/1996 Ishii ..... H01R 13/518 439/364
5,735,713 A * 4/1998 Sugiura ..... H01R 13/518 439/638
5,817,976 A * 10/1998 Yanase ..... H01H 85/2035 174/559
6,027,360 A * 2/2000 Jenkins ..... H01R 13/6215 439/248
6,459,590 B2 * 10/2002 Malnati ..... F25D 29/005 361/688
6,545,861 B1 * 4/2003 Hayes ..... H02B 1/18 174/536
6,570,088 B1 5/2003 Depp et al.
6,597,578 B2 * 7/2003 Shiina ..... B60R 16/0238 361/628
6,943,661 B2 * 9/2005 Janicek ..... H01C 1/02 338/22 R
7,001,187 B2 * 2/2006 Terunuma ..... H01R 9/226 439/76.2

(Continued)

*Primary Examiner* — Jean F Duverne
(74) *Attorney, Agent, or Firm* — Honigman Miller Schwartz and Cohn LLP

(57) ABSTRACT

A connector assemblies having a plurality of terminal cavities configured to hold a plurality of first terminal connections and a plurality of second terminal connections so as to minimize the bending of smaller wires is provided. The connector assembly includes a housing having a terminal board. The terminal cavities are disposed on the terminal board. The terminal cavities include a plurality of first terminal cavities configured to receive the plurality of first terminal connections and a plurality of second terminal cavities configured to receive the plurality of second terminal connections. The first terminal cavities are generally centered on the board so as to minimize a bend of the first wires when the plurality of first terminal connections are bundled with the plurality of second terminal connections.

16 Claims, 8 Drawing Sheets

(56) References Cited

U.S. PATENT DOCUMENTS

| | | | | |
|---|---|---|---|---|
| 7,901,254 | B2 * | 3/2011 | Dennes | H01R 9/2416 439/404 |
| 8,207,454 | B2 * | 6/2012 | Darr | H05K 7/026 174/520 |
| 2004/0029419 | A1 | 2/2004 | Uezono | |
| 2006/0141822 | A1 | 6/2006 | Ozawa et al. | |
| 2011/0043969 | A1 | 2/2011 | Shiraiwa et al. | |

* cited by examiner

CONNECTOR ASSEMBLY

TECHNICAL FIELD

The present specification generally relates to connector assemblies, and more particularly connector assemblies configured to maintain the structural integrity of the electric connections.

BACKGROUND

In general, connector assemblies include a housing and a terminal position assurance. The housing and the terminal position assurance are configured to engage each other in a pre-stage and a locked position. The housing includes a plurality of terminal cavities for housing a terminal connector.

The terminal connector includes a terminal head connected to a wire. The wire is electrically connected to the head. The terminal head is configured to engage a corresponding terminal connector. For instance, in the case of a female terminal connector, the terminal head may include a slot configured to receive a male blade of a male terminal connector. Alternatively, in the case of a male terminal connector, the terminal head may be a male blade configured to engage the slot of a female terminal connector.

Currently, the terminal position assurance and the housing are manufactured at a production plant and assembled together in a pre-stage position. The connector assembly is then shipped in an assembly plant wherein the terminal connectors are inserted into respective terminal cavities. The housing and the terminal position assurance are then pressed together to place the connector assembly in a locked position.

The wires are then bundled together by tape wherein the wires on the distal edges of the housing are pressed together. Thus, the wires on the distal edges are subjected to a larger flex relative to the wires in centered in the arrangement of the terminal cavities. Further, the bundles may be subjected to further bending so as to accommodate the installation of the connector assembly into a male connector assembly.

In some instances, it is desirable to have wires of different diameters so as to accommodate a desired electric connection. Previously, connector assemblies have used wires with a diameter larger than 2.8 mm. However, with the introduction of additional electric components and functionality, the use of wires with smaller diameters is needed. Such wires have a lower bending threshold and are more susceptible to breaking.

Accordingly, a need exists for a connector assembly wherein wires of a smaller diameter are positioned so as to be subjected to a minimal bend when the wires are bundled together or the bundle is bent to accommodate a packaging space.

SUMMARY

In one embodiment, a connector assembly configured to hold a plurality of first terminal connections and a plurality of second terminal connections so as to minimize the bending of smaller wires is provided. Each of the plurality of first terminal connections includes a first wire having a first diameter. Each of the plurality of second terminal connections includes a second wire having a second diameter. The first diameter is smaller than the second diameter.

The connector assembly includes a housing having a terminal board. The terminal board includes a plurality of first terminal cavities configured to receive the plurality of first terminal connections and a plurality of second terminal cavities configured to receive the plurality of second terminal connections. The first terminal cavities are generally centered on the board and the second terminal cavities bound the first terminal cavities on at least three sides so as to minimize a bend of the first wires when the plurality of first terminal connections are bundled with the plurality of second terminal connections.

In one embodiment the connector assembly is configured to hold a plurality of first terminal connection, a plurality of second terminal connections and a plurality of third terminal connections. Each of the plurality of first terminal connections include a first wire having a first diameter. Each of the plurality of second terminal connections include a second wire having a second diameter. Each of the plurality of third terminal connections include a third wire having a third diameter. The first diameter of the first wire is smaller than the second diameter of the second wire, and the second diameter of the second wire is smaller than the third diameter of the third wire. The connector assembly is configured to hold the plurality of first terminal connections so as to minimize a bend of the plurality of first wires when the plurality of first terminal connections, plurality of second terminal connection and plurality of third terminal connections are bundled together.

The connector assembly further includes a housing having a terminal board with a plurality of first terminal cavities configured to receive the first plurality of terminal connections. The terminal board further includes a plurality of second terminal cavities configured to receive the second plurality of terminal connections and a plurality of third terminal cavities configured to receive the plurality of third terminal connections. The first terminal cavities are centered on the board and the plurality of second terminal cavities and the plurality of third terminal cavities bound and the first terminal cavities on at least three sides so as to minimize a bend of the first wires when the plurality of first terminal connections are bundled with the plurality of second terminal connections and the plurality of third terminal connections.

In one embodiment, the plurality of first terminal cavities are arranged in a "T". In one embodiment, the "T" is formed by a column of first terminals and a row of first terminals. The "T" is surrounded by the second terminal cavities and the third terminal cavities. As the first terminals are centered on the terminal board, the first terminal connections are mounted as as to be generally centered on the board, wherein when the terminal connections are bundled together about the center of the board, bending of the first wires is minimized relative to the wires on the outer edges of the terminal board.

Accordingly, the connector assembly positions terminal connections with smaller wires in a position so as to minimize the bend of the wires when the terminal connections are bundled together.

BRIEF DESCRIPTION OF THE DRAWINGS

The embodiments set forth in the drawings are illustrative and exemplary in nature and not intended to limit the subject matter defined by the claims. The following description of the illustrative embodiments can be understood when read in conjunction with the following drawings, where like structure is indicated with like reference numerals and in which:

DETAILED DESCRIPTION

Referring generally to the figures, embodiments of the present disclosure include connector assemblies having a plurality of terminal cavities configured to hold a plurality of first terminal connections and a plurality of second terminal connections so as to minimize the bending of smaller wires is provided. Each of the plurality of first terminal connections includes a first wire having a first diameter. Each of the plurality of second terminal connections includes a second wire having a second diameter. The first diameter is smaller than the second diameter.

The terminal cavities are disposed on a terminal board. The terminal cavities include at least a plurality of first terminal cavities configured to receive the plurality of first terminal connections and a plurality of second terminal cavities configured to receive the plurality of second terminal connections. The first terminal cavities are generally centered on the board and the second terminal cavities bound the first terminal cavities on at least three sides so as to minimize a bend of the first wires when the plurality of first terminal connections are bundled with the plurality of second terminal connections.

As used herein the terms front and back are made in reference to the orientation of the related part when the retaining system is assembled, wherein the front refers to the portion of the part facing the other during assembly and the back refers to the portion of the part facing away from the front. The term top and down refer to the orientation of the part as shown in the figures.

Figure 1:
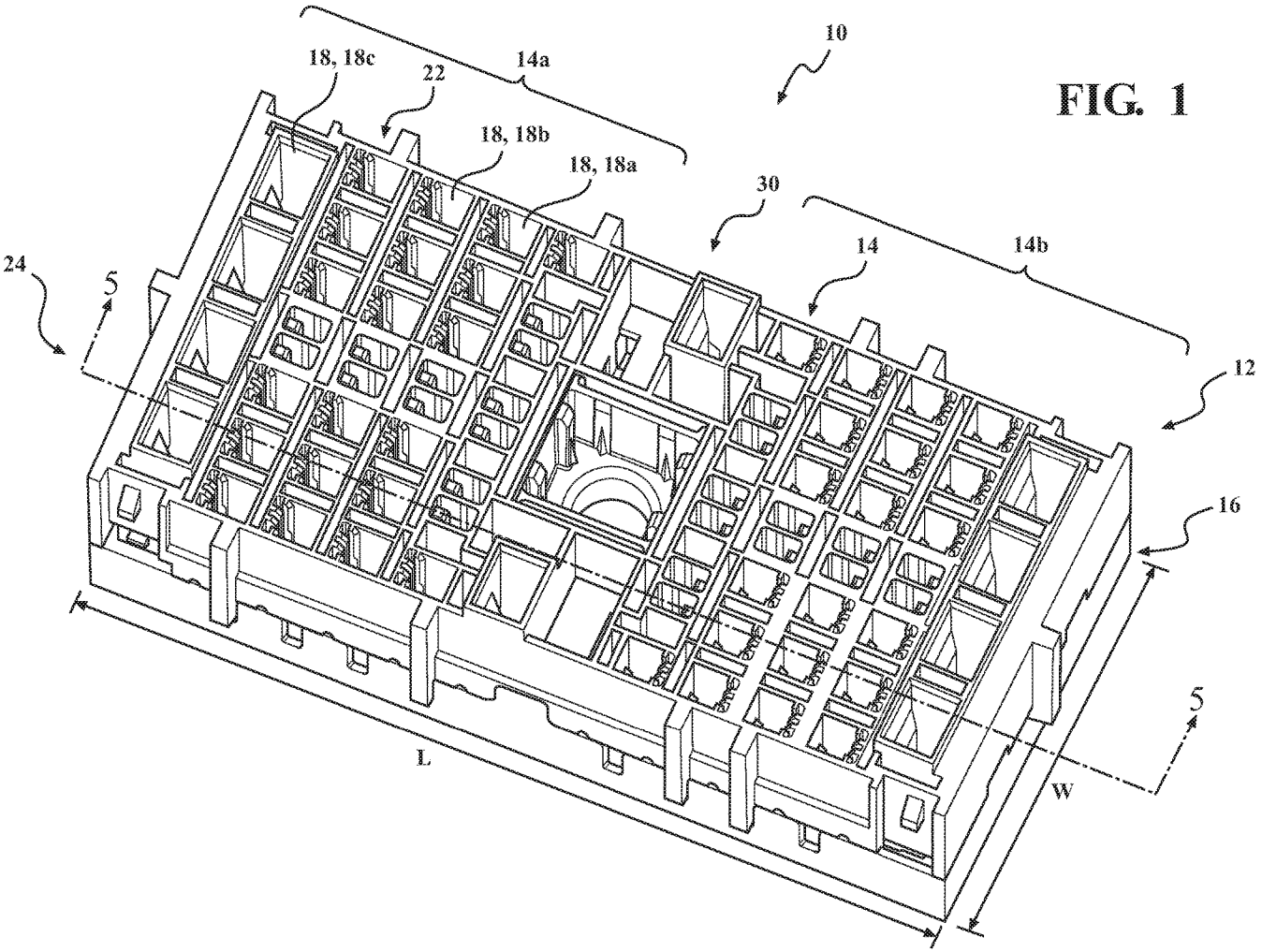
FIG. 1 schematically depicts a connector assembly according to one or more embodiments described and illustrated herein.

With reference first to FIG. 1 an embodiment of a connector assembly 10 according to one or more embodiments described herein is provided. The connector assembly 10 includes a housing 12 having a terminal board 14. The housing 12 is coupled to a terminal positioning assurance 16. The connector assembly 10 is illustratively shown as a female connector assembly however, it should be appreciated that the connector assembly 10 may be a male connector assembly and a female connector assembly is provided herein for illustrative purposes only.

Figure 6:
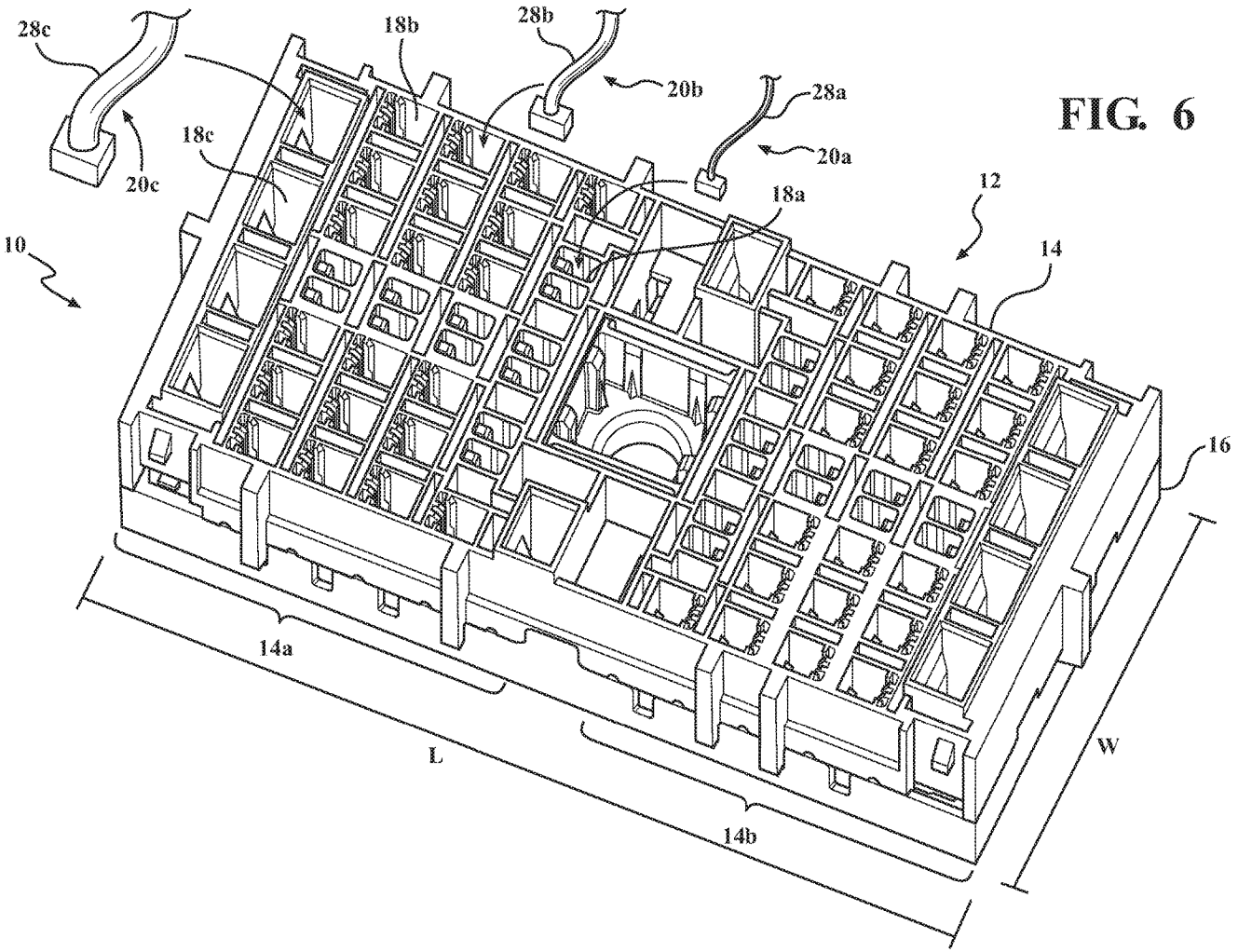
FIG. 6 is view of the connector assembly showing the terminal connections mounted in the terminal cavities.
Figure 7A:
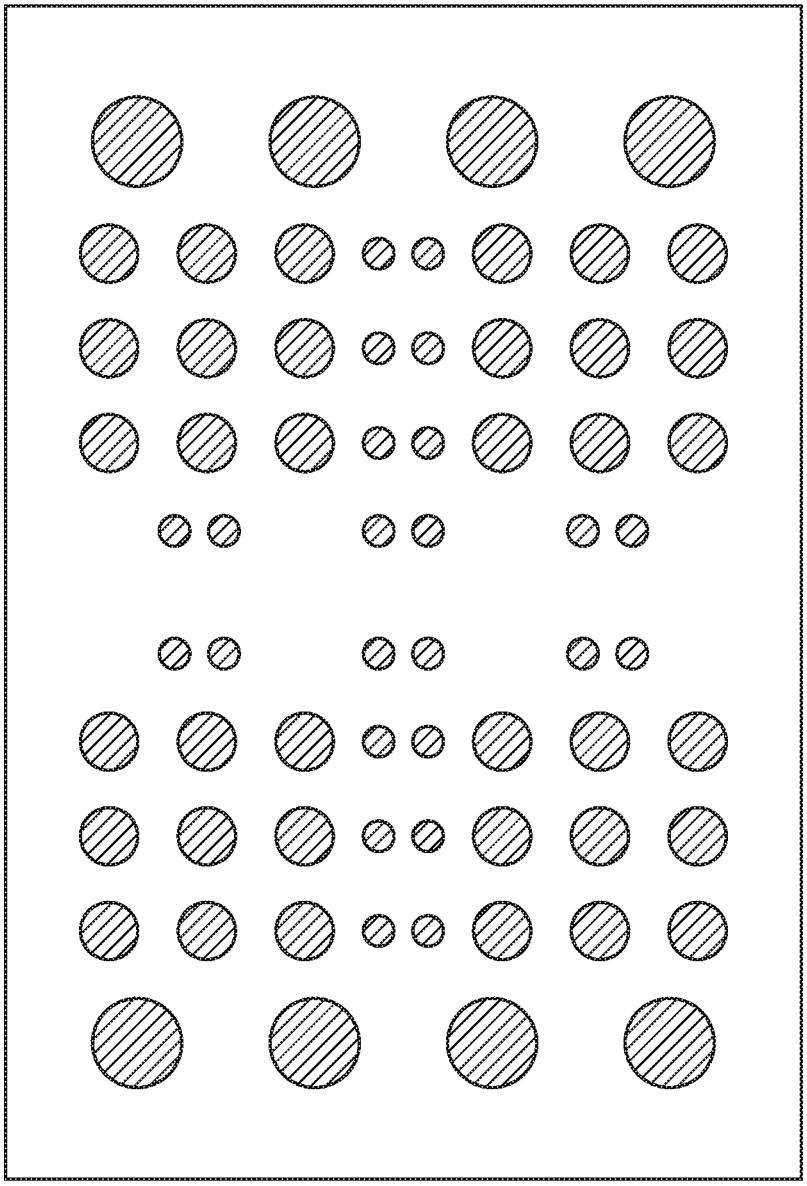
FIG. 7*a* is a schematic view showing wires of the terminal connections.
Figure 7B:
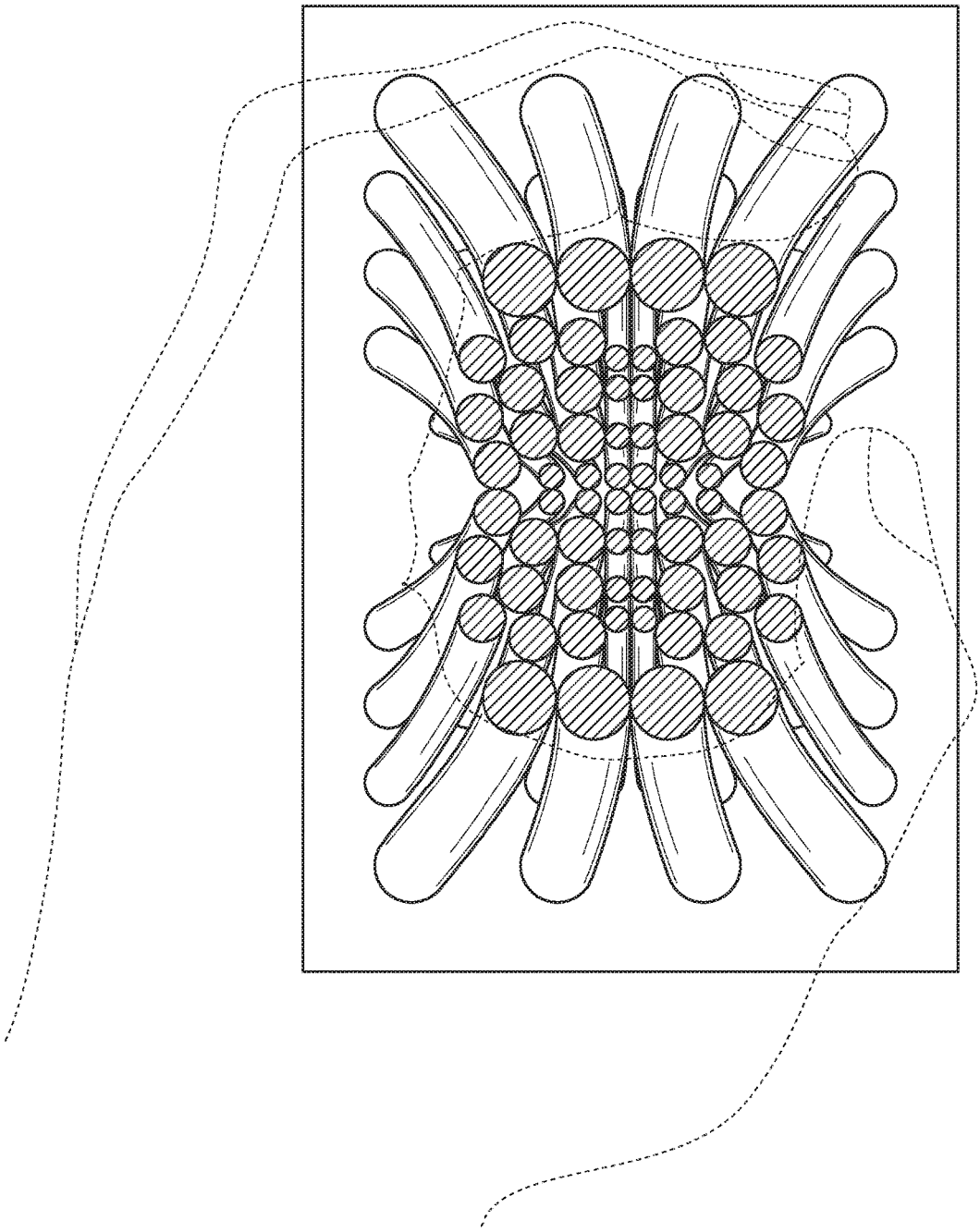
FIG. 7*b* is a schematic view showing the wires of the terminal connections bundled together.

The terminal board 14 includes terminal cavities 18 are configured to receive a terminal connection 20 (generally depicted in FIGS. 6 and 7*a*). For reference, the orientation of the terminal cavities 18 will be described in reference to rows 22 and columns 24, wherein a row 22 is defined by an axial alignment of the terminal cavities 18 along the width "W" of the terminal board 14. A column 24 is defined by an axial alignment of the terminal cavities 18 along the length "L" of the terminal board 14.

The connector assembly 10 may be configured to provide power to various electronic components, the size of the terminal connections 20 may vary. As used herein, 18 will designate a terminal cavity 18 in general, and an alphanumeric utilizing "18" is used to reference a specific terminal cavity 18. Likewise, the terminal connections are referenced herein generally as 20, and specifically in an alphanumeric utilizing "20". The first terminal cavities 18*a* are configured to receive the first terminal connections 20*a*. The second terminal cavities 18*b* are configured to receive the plurality of second terminal connections 20*b*.

Each of the first terminal connections 20*a* include a first wire 28*a* having a first diameter. Each of the second terminal connections 20*b* include a second wire 28*b* having a second diameter. The first diameter of the first wire 28*a* is smaller than the second diameter of the second wire 28*b*.

FIG. 1 provides a depiction of a back side of the terminal board 14. Each of the terminal cavities 18 are defined by four walls defining a generally cubic space. Each terminal cavity 18 may include features configured to engage the terminal positioning assurance 16 to support the terminal connection 20, either male or female.

For illustrative purposes, a general description of the terminal cavity 18 will be made in reference to one configured to hold a female terminal connection 20. In the case of a female terminal connection 20, the the terminal connection 20 includes a head 26 configured to receive the male blade of a male terminal connection 20. The head 26 is electrically connected to a wire 28. The head 26 is adapted to fit within the terminal cavity 18 wherein the wire 28 protrudes from the back side of the terminal board 14. The front side of the terminal board 14 is engaged with the terminal positioning assurance 16. The connector assembly 10 may then be mounted to a male connector assembly or a female connector assembly as the case may be.

FIG. 1 illustrates an embodiment of the first terminal cavities 18*a* being centered on the terminal board 14 and the second terminal cavities 18*b* bounding the first terminal cavities 18*a*. The first terminal connections 20*a* are inserted into the first terminal cavities 18*a* and the second terminal connections 20*b* are inserted into the second terminal cavities 18*b*. As the wires 28 protrude from the back side of the terminal board 14, bundling of the wires 28 are done in such a manner that the bundled wires 28 are centered with respect to the back side of the terminal board 14, as illustrative shown in FIG. 8*b*. Accordingly, the first wires 28*a* are not subject to the same degree of bending as the second wires 28.

In one embodiment, the terminal board 14 includes a plurality of first terminal cavities 18*a* configured to receive the plurality of first terminal connections 20*a* and a plurality of second terminal cavities 18*b* configured to receive the plurality of second terminal connections 20*b*. The first terminal cavities 18*a* are generally centered on the terminal board 14 and the second terminal cavities 18*b* bound the first terminal cavities 18*a* on at least three sides so as to minimize a bend of the first wires 28*a* when the plurality of first terminal connections 20*a* are bundled with the plurality of second terminal connections 20*b*.

The plurality of first terminal cavities 18*a* include a column 24 of first terminal cavities 18*a*. A first end and a second end of the column 24 is disposed between one of the second terminal cavities 18*b* and another of the second terminal cavities 18*b*. The second terminal cavities 18*b* are disposed on opposing sides of the terminal board 14. The first terminal cavities 18*a* may further include a row 22 of first terminal cavities 18*a*. A first end of the row 22 is contiguous with the column 24 so as to define a "T", and a second end of the row 22 is spaced apart from a peripheral edge of the terminal board 14. The second terminal cavities 18*b* are disposed between the peripheral edge of the terminal board 14 and the second end of the row 22. The illustrations depict an embodiment showing two rows 22 of first terminal cavities 18*a*.

In one embodiment, the first terminal cavities 18*a* are configured to receive a terminal connection 20 having a first wire 28*a* being generally 1.5 mm. The second terminal cavities 18*b* are configured to receive a terminal connection 20 having a second wire 28*b* being generally 2.8 mm. It should be appreciated that the number of terminal cavities 18 depicted in the illustrations are provided for illustrative purposes and is not limiting to the scope of the appended claims.

In one embodiment, the terminal board 14 includes a mounting structure 30. The mounting structure 30 is centered on the terminal board 14 and spans the width "W" of the terminal board 14. The mounting structure 30 may include a through-bore for receiving a fastener (not shown) configured to secure the connector assembly 10 to a platform.

The mounting structure 30 defines the terminal board 14 into a first half 14*a* and a second half 14*b*. A portion of the plurality of first terminal cavities 18*a* and a portion of the plurality of second terminal cavities 18*b* are positioned on the first half 14*a* of terminal board 14 and a remaining portion of the plurality of first terminal cavities 18*a* and a remaining portion of the plurality of second terminal cavities 18*b* are positioned on the second half 14*b* of the terminal board 14.

In one embodiment the connector assembly 10 is configured to hold a plurality of first terminal connections 20*a*, a plurality of second terminal connections 20*b* and a plurality of third terminal connections 20*c*. Each of the plurality of first terminal connections 20*a* include a first wire 28*a* having a first diameter. Each of the plurality of second terminal connections 20*b* include a second wire 28*b* having a second diameter. Each of the plurality of third terminal connections 20*c* include a third wire 28*c* having a third diameter. The first diameter of the first wire 28 is smaller than the second diameter of the second wire 28, and the second diameter of the second wire 28 is smaller than the third diameter of the third wire 28.

The connector assembly 10 further includes a housing 12 having a terminal board 14 with a plurality of first terminal cavities 18*a* configured to receive the first plurality of terminal connections 20. The terminal board 14 further includes a plurality of second terminal cavities 18*b* configured to receive the second plurality of terminal connections 20 and a plurality of third terminal cavities 18*c* configured to receive the plurality of third terminal connections 20.

The first terminal cavities 18*a* are centered on the terminal board 14 and the plurality of second terminal cavities 18*b* and the plurality of third terminal cavities 18*c* bound and the first terminal cavities 18*a* on at least three sides so as to minimize a bend of the first wires 28*a* when the plurality of first terminal connections 20*a* are bundled with the plurality of second terminal connections 20*b* and the plurality of third terminal connections 20.

In one embodiment, the terminal board 14 includes a mounting structure 30. The mounting structure 30 is centered on the terminal board 14 and spans the width "W" of the terminal board 14. The mounting structure 30 defines the terminal board 14 into a first half 14*a* and a second half. 14*b* A portion of the plurality of first terminal cavities 18*a* and a portion of the plurality of second terminal cavities 18*b* are positioned on the first half 14*a* of terminal board 14 and a remaining portion of the plurality of first terminal cavities 18*a* and a remaining portion of the plurality of second terminal cavities 18*b* are positioned on the second half 14*b* of the terminal board 14. The third terminal cavities 18*c* are arranged in a row 22 and disposed on opposite ends of the terminal board 14.

In one embodiment, the a first set of first terminal cavities 18*a* are arranged in a "T" one one side of the mounting structure 30, and a second set of first terminal cavities 18*a* are arranged in a "T" on the other side of the mounting structure 30. In one embodiment, the "T" is formed by a column 24 of first terminals and a row 22 of first terminals. However, it should be appreciated that the "T" may be formed otherwise, for instance, two rows 22 of first terminal cavities 18*a* may be used.

It should also be appreciated that the first terminal cavities 18*a* need not be arranged in the shape of a "T", and that the particular arrangement shown in the FIGS. is provided for a terminal board 14 configured to fit 74 terminal cavities 18. In particular, the terminal board 14 includes twelve (12) first terminal cavities 18*a* on both sides of the mounting structure 30, ten (10) second terminal cavities 18*b* one both sides of the mounting structure 30, and four third terminal cavities 18*c* on both sides of the mounting structure 30. The "T" is surrounded by the second terminal cavities 18*b*, the third terminal cavities 18*c* and the mounting structure 30.

Figure 2:
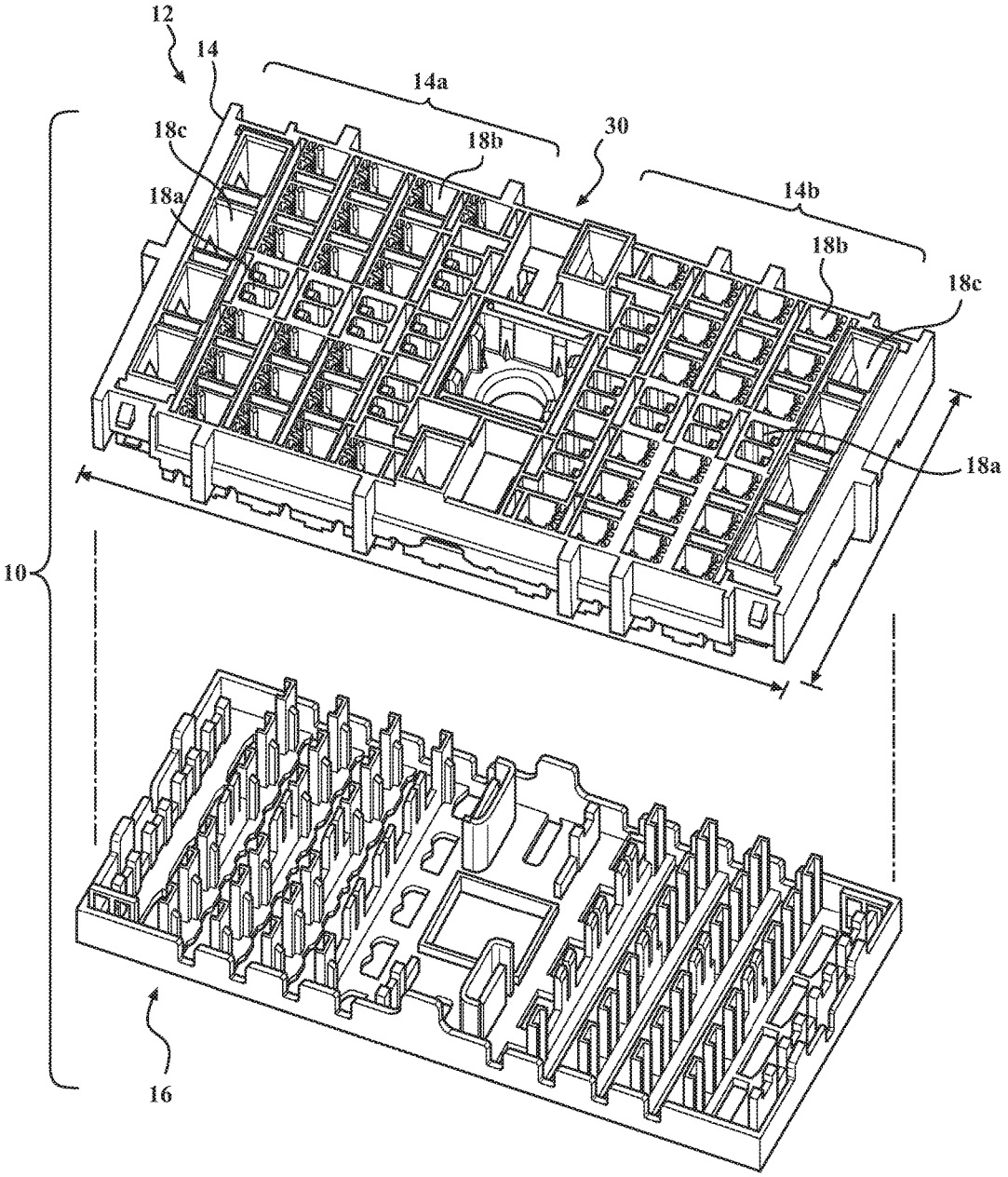
FIG. 2 is a an exploded view of the connector assembly shown in FIG. 1.
Figure 4:
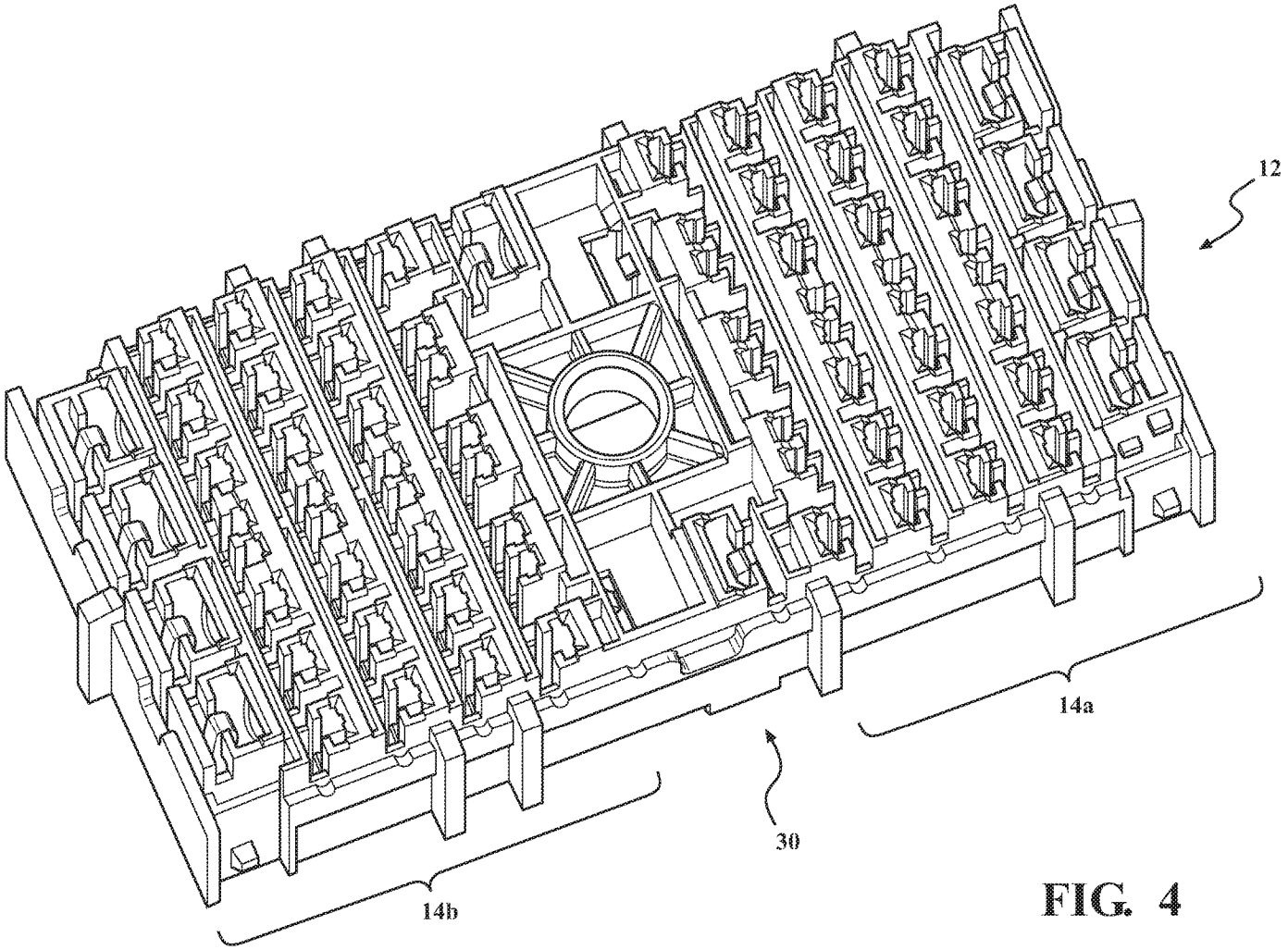
FIG. 4 is an isolated view of the housing shown in FIG. 2 taken from the front.
Figure 5:
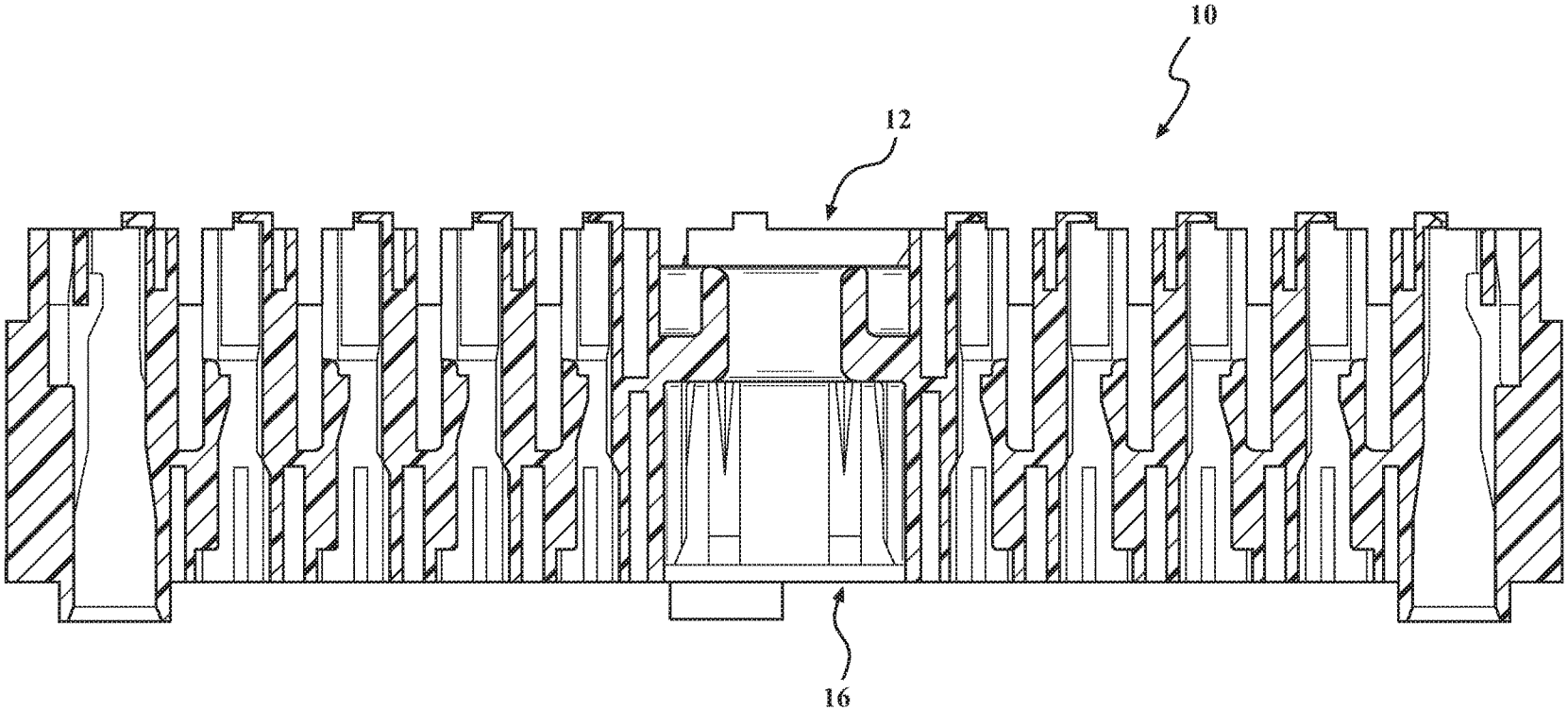
FIG. 5 is a cross-sectional view of FIG. 1 taken along lines 5-5.

Assembly of the connector assembly 10 may be done by insertion of the terminal connections 20 into corresponding terminal cavities 18. As shown in FIG. 2, the front side of the housing 12 and the back side of the terminal positioning assurance 16 are configured to couple together wherein wedges of the terminal positioning assurance 16 are inserted into respective terminal cavities 18 of the terminal board 14 from the front side. FIG. 4 provides a perspective view of the front side of the terminal board 14, showing ledges disposed in each of the terminal cavities 18.

Figure 3:
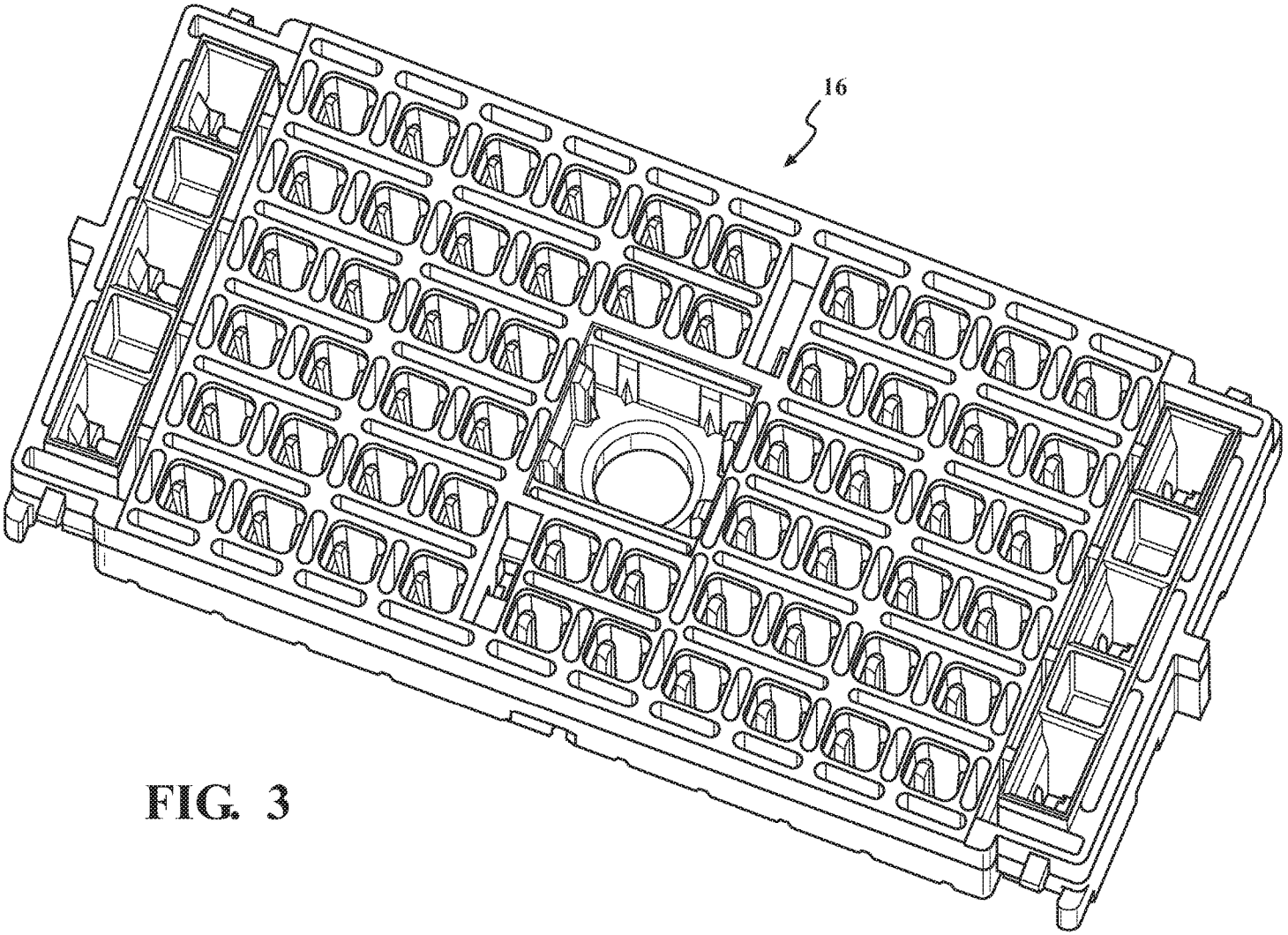
FIG. 3 is an isolated view of a terminal positioning assurance shown in FIG. 2.

FIG. 3 provides view of the front side of the terminal positioning assurance 16. The terminal positioning assurance 16 includes a generally planar front side, with a plurality of openings having a dimension generally similar to that of the terminal cavities 18 so as to present a through passage. The heads 26 of the terminal connections 20 are inserted into the openings so as to be disposed beneath the planar front side of the terminal positioning assurance 16.

The housing 12 is first inserted into the terminal positioning assurance 16 in a prestage condition, wherein the wedges of the terminal positioning assurance 16 are engaged with respective ledges of the terminal board 14. The terminal connections 20 are then inserted into the respective terminal cavities 18 (as indicated by FIG. 6), and the terminal positioning assurance 16 and the housing 12 are further pressed together such that the wedges of the terminal positioning assurance 16 are fully engaged with the ledges of the terminal cavities 18, as shown in FIG. 6.

In such an arrangement, the wires 28 of the terminal connections 20 protrude from a back side of the terminal board 14. As the first terminals are centered on the terminal board 14, the first terminal connections 20*a* are mounted as as to be generally centered on the terminal board 14, wherein when the terminal connections 20 are bundled together about the center of the terminal board 14, bending of the first wires 28*a* is minimized relative to the wires 28 on the outer edges of the terminal board 14.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A connector assembly configured to hold a plurality of first terminal connections and a plurality of second terminal connections, wherein each of the plurality of first terminal connections include a first wire having a first diameter, and wherein each of the plurality of second terminal connections include a second wire having a second diameter, the first diameter being smaller than the second diameter, the connector assembly comprising:

a housing having a terminal board with a plurality of first terminal cavities configured to receive the plurality of first terminal connections and a plurality of second terminal cavities configured to receive the plurality of second terminal connections, wherein all of the plurality of first terminal cavities are centered on the board and the second terminal cavities bound the first terminal cavities on at least three sides so as to minimize a bend of the first wires when the plurality of first terminal connections are bundled with the plurality of second terminal connections.

2. The connector assembly as set forth in claim 1, wherein the plurality of first terminal cavities include a column of first terminal cavities, wherein a first end and a second end of the column is disposed between one of the plurality of second terminal cavities and another of the plurality of second terminal cavities.

3. The connector assembly as set forth in claim 2, wherein the plurality of first terminal cavities further include a row of first terminal cavities, wherein a first end of the row is contiguous with the column, and wherein a second end of the row is spaced apart from a peripheral edge of the terminal board.

4. The connector assembly as set forth in claim 3, wherein at least one of the plurality of second terminal cavities is disposed between the peripheral edge of the terminal board and the second end of the row.

5. The connector assembly as set forth in claim 3, further including a plurality of third terminal cavities configured to receive a third plurality of terminal connections, wherein each of the plurality of third terminal connections include a third wire having a third diameter, the third diameter larger than the second diameter.

6. The connector assembly as set forth in claim 5, wherein each of the plurality of first terminal cavities are configured to receive a terminal wire connection having a wire being generally 1.5 mm, wherein each of the plurality of second terminal cavities are configured to receive a terminal wire connection having a wire being generally 2.8 mm, and each of the plurality of third terminal cavities are configured to receive a terminal wire connection having a wire being generally 6.3 mm.

7. The connector assembly of claim 2, wherein the terminal board includes a mounting structure bisecting the terminal board into a first half and a second half, wherein a portion of the plurality of first terminal cavities and a portion of the plurality of second terminal cavities are positioned on the first half of terminal board and a remaining portion of the plurality of first terminal cavities and a remaining portion of the plurality of second terminal cavities are positioned on the second half of the terminal board.

8. The connector assembly of claim 1, wherein the terminal board is configured to receive a female terminal connection.

9. A connector assembly configured to hold a plurality of first terminal connection, a plurality of second terminal connections and a plurality of third terminal connections, wherein each of the plurality of first terminal connections include a first wire having a first diameter, each of the plurality of second terminal connections include a second wire having a second diameter, and each of the plurality of third terminal connections include a third wire having a third diameter, the first diameter being smaller than the second diameter, the second diameter being smaller than the third diameter, wherein the connector assembly is configured to hold the plurality of first terminal connections so as to minimize a bend of the plurality of first wires when the plurality of first terminal connections, plurality of second terminal connection and plurality of third terminal connections are bundled together, the connector assembly comprising:

a housing having a terminal board with a plurality of first terminal cavities configured to receive the first plurality of terminal connections, a plurality of second terminal cavities configured to receive the second plurality of terminal connections, and a plurality of third terminal cavities configured to receive the plurality of third terminal connections wherein the first terminal cavities are centered on the board and the plurality of second terminal cavities and the plurality of third terminal cavities bound and the first terminal cavities on at least three sides so as to minimize a bend of the first wires when the plurality of first terminal connections are bundled with the plurality of second terminal connections and the plurality of third terminal connections.

10. The connector assembly as set forth in claim 9, wherein the plurality of first terminal cavities include a column of first terminal cavities, wherein a first end and a second end of the column is disposed between one of the plurality of second terminal cavities and another of the plurality of second terminal cavities.

11. The connector assembly as set forth in claim 10, wherein the plurality of first terminal cavities further include a first row of first terminal cavities, wherein a first end of the first row is contiguous with the column, and wherein a second end of the first row is spaced apart from a peripheral edge of the terminal board.

12. The connector assembly as set forth in claim 11, wherein the plurality of first terminal cavities include a second row parallel and adjacent the first row.

13. The connector assembly as set forth in claim 9, wherein the plurality of first terminal cavities are arranged in a "T".

14. The connector assembly as set forth in claim 9, wherein the plurality of third terminal cavities include a first column and a second column, the first column is disposed along a first side edge of the terminal board, and the second column disposed on a second side edge of the terminal board.

15. The connector assembly as set forth in claim 9, wherein each of the plurality of first terminal cavities are configured to receive a terminal wire connection having a wire being generally 1.5 mm, wherein each of the plurality of second terminal cavities are configured to receive a terminal wire connection having a wire being generally 2.8 mm, and each of the plurality of third terminal cavities are configured to receive a terminal wire connection having a wire being generally 6.3 mm.

16. The connector assembly of claim 9, wherein the terminal board includes a mounting structure bisecting the board into a first half and a second half, wherein a portion of the plurality of first terminal cavities, a portion of the plurality of second terminal cavities and a portion of the plurality of third terminal cavities are positioned on the first half of terminal board and a remaining portion of the plurality of first terminal cavities, a remaining portion of the plurality of second terminal cavities and a remaining portion of the plurality of third terminal cavities are positioned on the second half of the terminal board.

* * * * *